US007959194B2

(12) United States Patent
Mahoney

(10) Patent No.: US 7,959,194 B2
(45) Date of Patent: Jun. 14, 2011

(54) LATCH ASSEMBLY AND ARRANGEMENT INCLUDING A LATCH ASSEMBLY

(75) Inventor: William C. Mahoney, High Point, NC (US)

(73) Assignee: Volvo Group North America, LLC, Greensboro, NC (US)

( * ) Notice: Subject to any disclaimer, the term of this patent is extended or adjusted under 35 U.S.C. 154(b) by 27 days.

(21) Appl. No.: 11/911,854

(22) PCT Filed: May 20, 2005

(86) PCT No.: PCT/US2005/017637

§ 371 (c)(1), (2), (4) Date: Oct. 18, 2007

(87) PCT Pub. No.: WO2006/126985

PCT Pub. Date: Nov. 30, 2006

(65) Prior Publication Data

US 2008/0224480 A1 Sep. 18, 2008

(51) Int. Cl.
*E05C 19/10* (2006.01)
*E05C 19/00* (2006.01)

(52) U.S. Cl. ..... 292/99; 292/95; 292/121; 292/251.5

(58) Field of Classification Search ..... 292/95, 292/99, 121, 130, 136, 216, 230, 238, 251.5
See application file for complete search history.

(56) References Cited

U.S. PATENT DOCUMENTS 1,002,259 A * 9/1911 Goedeke ..... 292/121
1,016,422 A * 2/1912 Lauritsen ..... 292/121
1,133,254 A 3/1915 Backus
1,155,953 A * 10/1915 Morrow ..... 292/130
1,762,883 A * 6/1930 Norman ..... 292/254
1,830,786 A * 11/1931 Ferris ..... 292/136
2,246,787 A 6/1941 Dall
2,288,926 A * 7/1942 Strader ..... 292/99
2,517,185 A * 8/1950 Elmer ..... 292/130
3,433,518 A * 3/1969 Foltz ..... 292/238
3,463,530 A * 8/1969 Modes ..... 292/128
3,620,560 A 11/1971 Peters
4,005,898 A 2/1977 Way
4,273,368 A 6/1981 Tanaka
4,690,440 A * 9/1987 Rogers ..... 292/54

(Continued)

FOREIGN PATENT DOCUMENTS

JP 01219272 2/1988

(Continued)

OTHER PUBLICATIONS

International Search Report for corresponding International Application PCT/US2005/017637.

(Continued)

*Primary Examiner* — Carlos Lugo
(74) *Attorney, Agent, or Firm* — WRB-IP LLP

(57) ABSTRACT

A latch assembly includes a plate and an arm pivotable between a closed and an open position relative to the plate about a pivot axis. The pivot axis is substantially aligned with a line of entry of a connecting bar to a latched position in which, when the arm is in the closed position, the connecting bar is entirely surrounded by both the plate and the arm together and partially surrounded by the arm and the plate individually. The plate is fixed relative to the line of entry.

23 Claims, 3 Drawing Sheets

U.S. PATENT DOCUMENTS

| | | | | | |
|---|---|---|---|---|---|
| 4,871,203 | A | * | 10/1989 | Rogers | 292/238 |
| 4,887,854 | A | * | 12/1989 | Bulten | 292/238 |
| D320,545 | S | * | 10/1991 | Sciarrino | D8/339 |
| 5,209,530 | A | * | 5/1993 | Kolloch | 292/27 |
| 5,358,292 | A | * | 10/1994 | Van Wiebe et al. | 292/235 |
| 5,432,963 | A | | 7/1995 | Coral et al. | |
| 5,655,801 | A | * | 8/1997 | Casey | 292/210 |
| 5,984,404 | A | | 11/1999 | Novoa et al. | |
| 6,092,845 | A | * | 7/2000 | Koenig | 292/225 |
| 6,422,626 | B1 | | 7/2002 | Beigel | |
| 6,485,071 | B2 | * | 11/2002 | Schwaiger | 292/216 |
| 6,578,905 | B1 | | 6/2003 | Buchanan et al. | |
| 6,591,554 | B2 | | 7/2003 | Kumer, Jr. | |
| 6,659,516 | B2 | * | 12/2003 | Wang et al. | 292/251.5 |
| 6,682,129 | B2 | | 1/2004 | Baggett et al. | |
| 6,735,797 | B1 | | 5/2004 | Long et al. | |
| 6,808,080 | B2 | * | 10/2004 | Spiers et al. | 220/263 |
| 7,032,939 | B2 | * | 4/2006 | Magnusson | 292/333 |
| 7,405,927 | B2 | * | 7/2008 | Lev | 361/679.55 |
| 2006/0012184 | A1 | * | 1/2006 | Ottesen et al. | 292/216 |

FOREIGN PATENT DOCUMENTS

| | | | |
|---|---|---|---|
| JP | 10238187 | A | 9/1998 |

OTHER PUBLICATIONS

Patent Abstracts of Japan for JP 10-238187, published Sep. 8, 1998, applicant Sanpou Lock Co. Ltd.

Patent Abstracts of Japan for JP 01-219272, published Sep. 1, 1989, applicant Shimizu Yoshio.

* cited by examiner

LATCH ASSEMBLY AND ARRANGEMENT INCLUDING A LATCH ASSEMBLY

BACKGROUND AND SUMMARY

The present invention relates generally to latching arrangements.

To erect certain articles such as table tops, bunks, cabinets, chairs, and the like, it is common to latch them to other articles, such as walls, particularly in arrangements such as truck cabs and ship or boat cabins where the most use must be made of relatively little space. When the articles are not in use, they can typically be folded out of the way or otherwise stowed and, often, are latched in the folded or stowed position, as well. There are, of course, numerous uses for latch assemblies in other forms of arrangements, as well, such as on gates, and on automobile doors, hoods, and trunks, to name but a few.

It is usually desirable to make latches as unobtrusive as possible. However, most latches are designed such that they have relatively high profiles. Walls to which articles such as table tops, bunks, cabinets, chairs and the like are latched often have fairly large, obtrusive recesses in which connecting or striker bars intended to mate with other latch components on the articles are disposed. It is desirable to provide a latch assembly that can have a comparatively low profile such that the size of a recess in which a connector bar for the latch assembly is disposed can be minimized.

According to an aspect of the present invention, a latch assembly comprises a plate and an arm pivotable between a closed and an open position relative to the plate about a pivot axis. The pivot axis is substantially aligned with a line of entry of a connecting bar to a latched position in which, when the arm is in the closed position, the connecting bar is entirely surrounded by both the plate and the arm together and partially surrounded by the arm and the plate individually, the plate being fixed relative to the line of entry.

According to another aspect of the present invention, an arrangement comprising a latch assembly is provided. The arrangement comprises a first assembly comprising a surface and, extending relative to the surface, a connecting bar. The arrangement also comprises a second assembly comprising a surface and a plate attached to the surface, and an arm pivotable between a closed and an open position relative to the plate about a pivot axis, and wherein the pivot axis is substantially aligned with a line of entry of the connecting bar to a latched position in which, when the arm is in the closed position, the connecting bar is entirely surrounded by both the plate and the arm together and partially surrounded by the arm and the plate individually, the plate being fixed relative to the line of entry.

In accordance with still another aspect of the present invention, a latch assembly includes a plate and an arm, at least one of the plate and the arm being pivotable about a pivot axis such that the plate and the arm are adapted to define a closed and an open position. The pivot axis is substantially aligned with a line of entry of a connecting bar to a latched position in which, when the plate and the arm are in the closed position, the connecting bar is entirely surrounded by both the plate and the arm together and partially surrounded by the arm and the plate individually. At least one of the plate and the arm is fixed relative to the line of entry.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
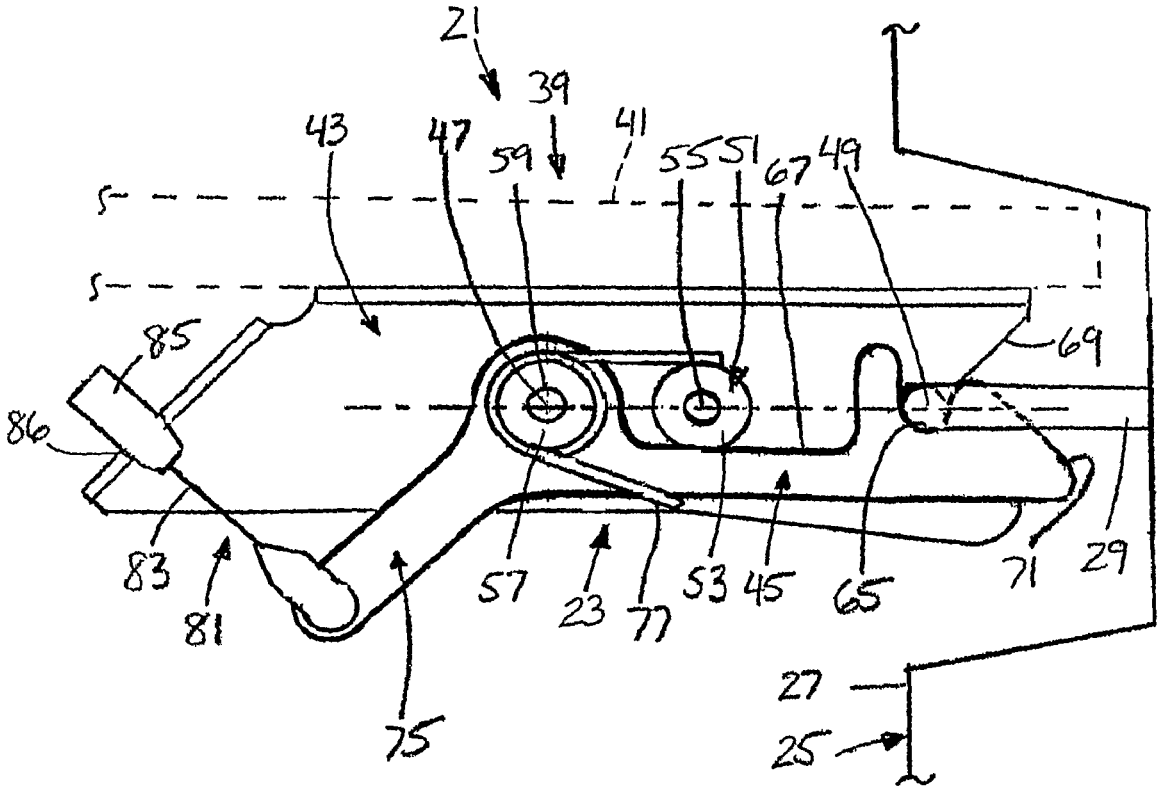
FIG. 1 is a side, partially broken view of an arrangement comprising a latch assembly according to an embodiment of the present invention showing the latch assembly in a closed position.
Figure 2:
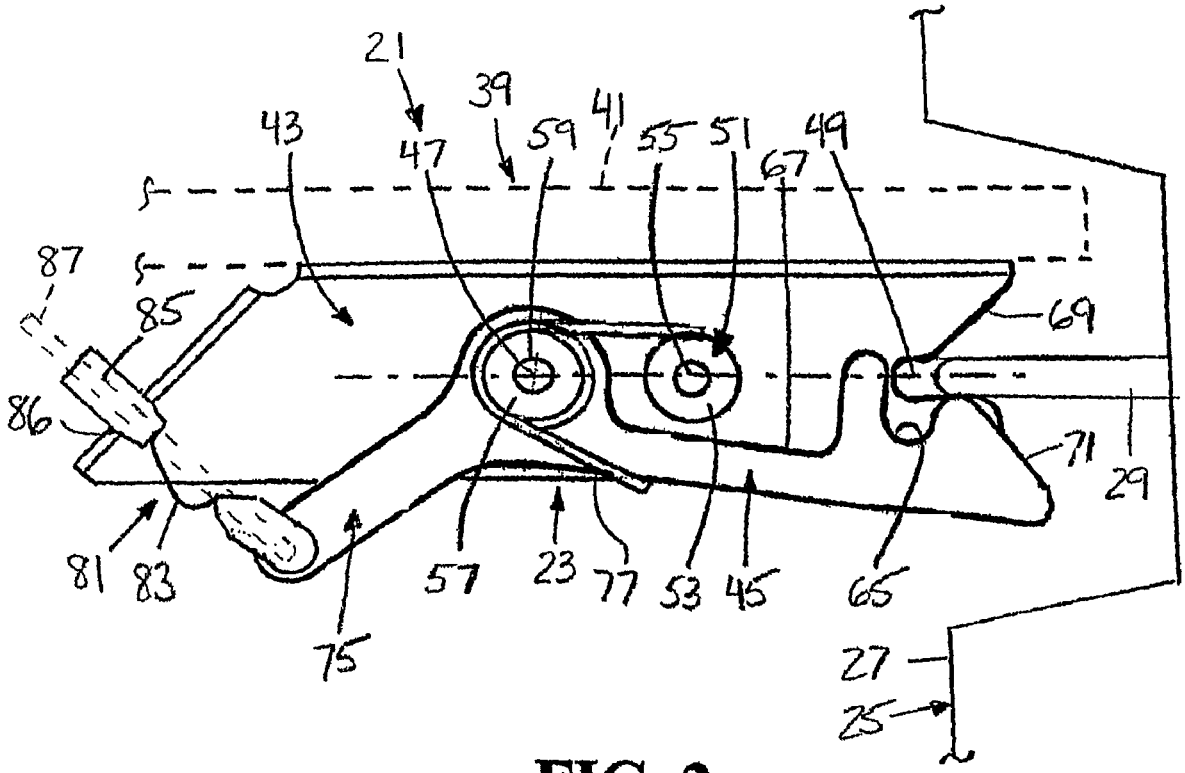
FIG. 2 is a side, partially broken view of the arrangement of FIG. 1 showing the latch assembly in an open position.
Figure 3:
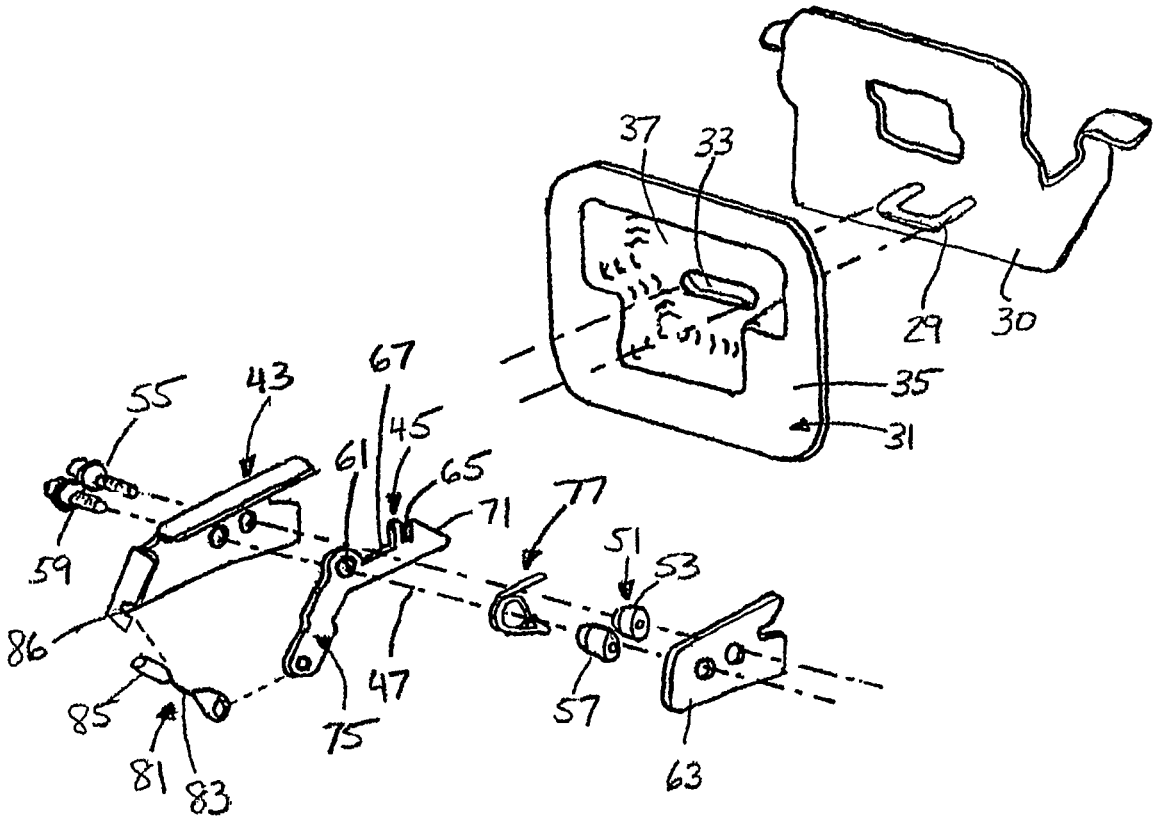
FIG. 3 is a perspective, exploded view of the arrangement of FIG. 1.

An arrangement 21 comprising a latch assembly 23 is shown in FIGS. 1 and 2. The arrangement comprises a first assembly 25 comprising a surface 27 such as a wall and, extending relative to the surface, a connecting bar 29. The connecting bar 29 may be in any suitable form, such as in the form of a U-shaped member as illustrated in FIG. 3 or in the form of a striker pin.

The connecting bar 29 can extend from a member 30 (FIG. 3) that is secured inside of the wall 27 and is substantially concealed by a member such as the member that is referred to here as a bezel 31. The bezel 31 comprises an opening 33 through which the connecting bar extends, an outer surface 35, and a recess 37 in the outer surface in which the opening is disposed. The connecting bar 29 may extend past the outer surface 35 of the bezel 31 but, ordinarily, will not so that it does not project into an area proximate the wall 27 and present a hazard. The recess 37 can be formed with walls shaped to help guide an entering latch assembly 23 toward the connecting bar 29, such as by sloping inwardly in a direction away from the surface 35. The connecting bar 29 may be a rigid bar or a flexible member such as a cable, and can take any suitable form, such as having a U-shape or being a straight member, and such as being circular in shape as shown or having some other shape, such as the shape of a plate.

As seen in FIGS. 1 and 2, the arrangement 21 also comprises a second assembly 39 comprising a surface 41 (shown in phantom) and the latch assembly 23 including a plate 43 attached to the surface. The surface 41 may be any number of structures, such as a table top, a bunk, a chair, a cabinet, to name but a few. The plate 43 may be attached to the surface 41 in any suitable manner, such as by bolts extending through a flanged portion of the plate.

The latch assembly 23 also comprises an arm 45 pivotable between a closed position (FIG. 1) and an open position (FIG. 2) relative to the plate 43 about a pivot axis 47. Thus, the plate 43, and the surface 41 attached to the plate, can also be considered to pivot about the pivot axis 47 relative to the arm 45. The pivot axis 47 is substantially aligned with a line of entry 49 of the connecting bar 29 to a latched position in which, when the arm 45 is in the closed position, the connecting bar is entirely surrounded by both the plate 43 and the arm together and partially surrounded by the arm and the plate individually. The arm 45 can extend parallel to the line of entry 49 when the arm is in the closed position. Ordinarily, to minimize the height of the latch assembly 23, the plate 43 is fixed relative to the line of entry 49 although the plate, to which the surface is attached, might alternatively be pivotable and the arm can be fixed relative to the line of entry.

Because the connecting bar 29 is only partially surrounded by the arm 45 and the plate 43 individually, the latch-assembly 23 can include latch assemblies wherein dimensions of the latch assembly can be minimized as compared to latch assemblies wherein one or more components individually include material surrounding a connecting bar by 360°. By minimizing latch assembly dimensions, it is possible to minimize the size of any recess for a connecting bar in any structure to be latched to a structure to which the latch assembly is connected.

A "latch assembly" in the sense used in the present application comprises a plate and an arm. The structure comprising the latch assembly may comprise, but does not necessarily also comprise, components that typically are sold together with the plate and the arm, such as a connecting bar, a table, a cabinet, a bunk, a truck cab, or a truck. "Line of entry" in the sense used in the present application is intended to refer to the line along which the connecting bar 29 travels from the point at which the arm 45 is pivoted to the fully open position as shown in FIG. 2 to the point at which the arm 45 is pivoted to the closed position as shown in FIG. 1, as when the connecting bar is in the latched position. Terms such as "can" and "may" are open-ended and are intended to reflect that something can or may be provided, but that something is not essential; however, the failure to use such terms is not intended to reflect that something is essential. Similarly, open ended terms such as "comprise" and "include" are intended to have the same meaning and are not intended to exclude the presence of other structure, materials, or acts.

The latch assembly 23 shown in FIGS. 1 and 2 comprises a stop 51 arranged to stop the arm 45 in the closed position. The stop 51 can be in any suitable form. The stop 51 shown in FIGS. 1 and 2 comprises a cylinder 53 bolted to the plate 43 by a bolt 55. A similar cylinder 57 is bolted to the plate 43 by a bolt 59 to define a pivot assembly centered around the pivot axis 47. The arm 45 includes an opening 61 (FIG. 3) in which the cylinder 57 of the pivot assembly is disposed. The cylinders 53 and 57 can be used to facilitate mounting of a cover plate 63 (FIG. 3) at a suitable spacing from the plate 43.

In the embodiment shown in FIGS. 1 and 2, the stop 51 is substantially aligned with the line of entry 49. The stop may be disposed elsewhere, however, aligning the stop 51 with the line of entry 49 facilitates minimizing the dimensions of the latch assembly 23. The arm 45 is typically formed with a notch 65 for receiving the connecting bar 29 at a point remote from the pivot axis 47. The notch 65 can be substantially aligned with the line of entry 49, which will ordinarily aid in keeping the size of the latch assembly 23 to a minimum. The arm 45 can be formed with a recessed area 67 between the pivot axis 47 and the notch 65 where the stop 51 is intended to contact the arm. In this way, the combined thickness of the arm 45 and the stop 51 does not make the latch assembly 23 unnecessarily large.

A forward surface 69 of the plate 43 and a forward surface 71 of the arm 45 can be sloped or otherwise arranged to define a V-shape when the arm is in the closed position. The V-shape can facilitate guiding of the connector bar 29 from an unlatched position to the latched position. The centerline of the V-shape can be substantially parallel to the line of entry 49.

Figure 4A:
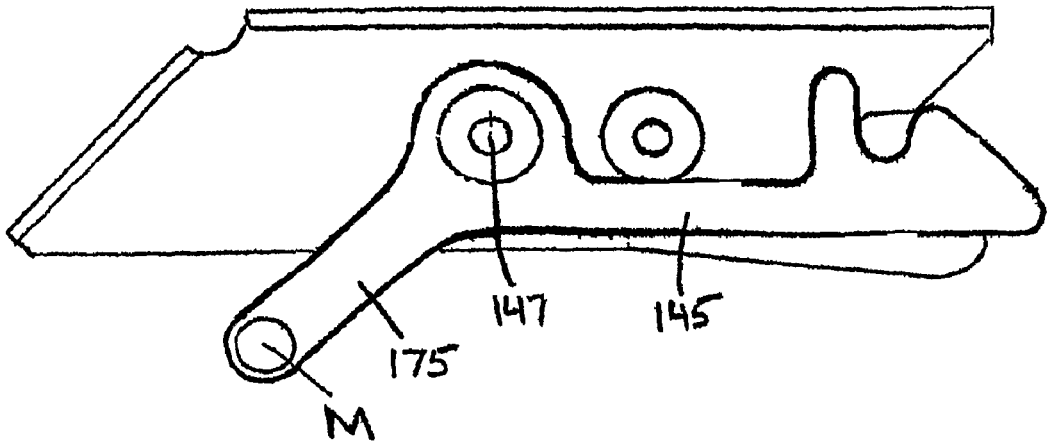
FIG. 4A is a side view of a latch assembly according to an embodiment of the present invention.
Figure 4B:
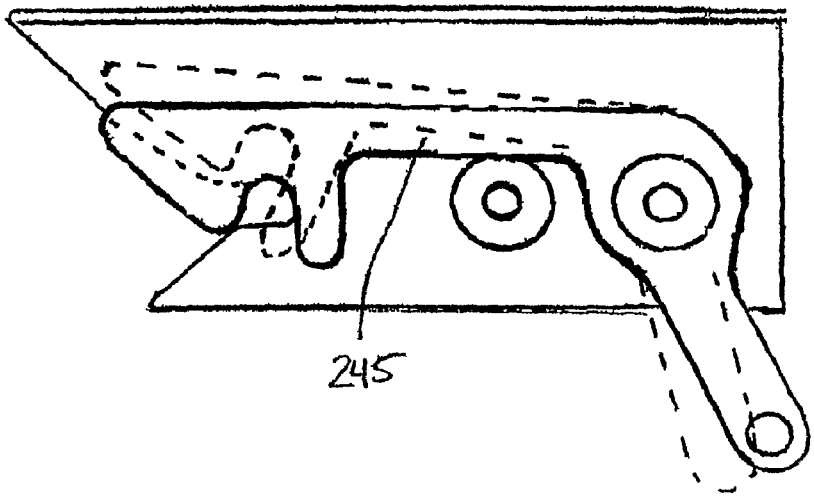
FIG. 4B is a side view of a latch assembly according to another embodiment of the present invention.
Figure 5:
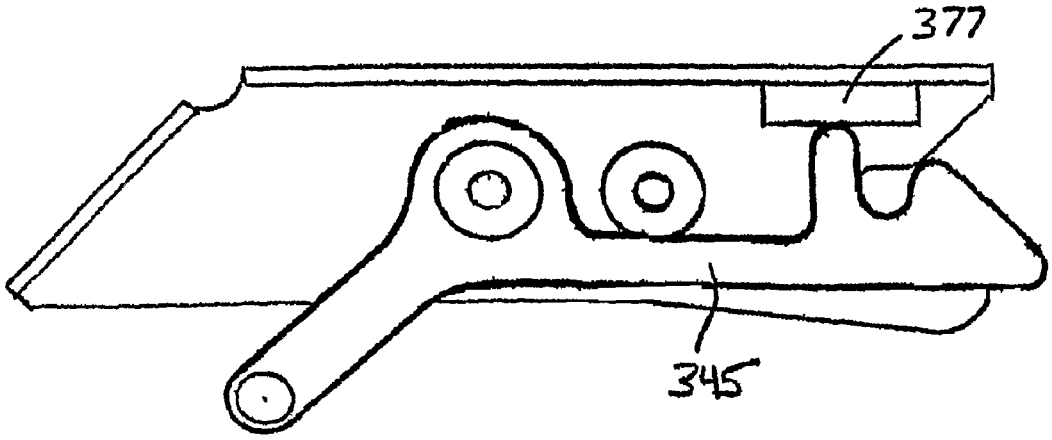
FIG. 5 is a side view of a latch assembly according to still another embodiment of the present invention.

In the latch assembly 23, it is desirable that the arm 45 automatically tends to move to the closed position. This can be accomplished by the arm 45 being arranged so that a force such as gravity causes the arm to pivot about the pivot axis 47 to the closed position. For example, as shown in FIG. 4A, a second arm 175 can extend from a pivot axis 147 of an arm 145 and be weighted by a mass M so that gravity will cause the arm to pivot upwardly to the closed position; or, as shown in FIG. 4B, the arm 245 can be arranged so that it pivots downwardly to a closed position. Ordinarily, however, some form of non-gravity means for causing the arm to move to the closed position will be provided. As seen in FIGS. 1 and 2, a spring 77 such as a torsion spring can be arranged to move the arm 45 to the closed position. Instead of torsion springs, other resilient spring devices can be used, such as compression or tension springs, compressible rubber members, and the like. Yet another possible non-gravity means for causing an arm 345 to move to the closed position is seen in FIG. 5 and is in the form of a magnet 377, which may be a permanent magnet or an electro-magnet that attracts a ferromagnetic arm or a magnet mounted on an arm. Of course, the arm may also be moved manually between a closed and an open position, if desired.

As seen in FIGS. 1 and 2, the arm 45 can form part of a lever, the lever comprising a second arm 75 extending from proximate the pivot axis 47. The second arm 75 can extend substantially parallel to the arm 45, although FIGS. 1 and 2 show the arm extending at a non-zero angle relative to the arm and relative to the line of entry 49. Having the second arm 75 extend at a non-zero angle relative to the arm 45 and the line of entry 49 can be useful to, inter alia, facilitate activating the arm so that it moves from the closed to the open position.

An activating member 81 can be attached to the arm 45 or the second arm 75 and arranged such that application of a force upon the activating member tends to move the arm to the open position. The activating member 81 in FIGS. 1 and 2 is in the form of a cable 83 including an enlarged portion 85 that can be attached to the plate 43, such as in a notch 86, to keep the cable in a desired location. The activating member 81 can also function as a stop to limit pivoting of the arm 45 relative to the plate 43. By pulling on the cable 83, the activating member 81 will cause the arm 45 to pivot from a closed position (FIG. 1) to an open position (FIG. 2). Instead of activating members in the form of flexible members such as cables, rigid activating members such as the rod 87 shown in phantom in FIG. 2 can be used. The activating member need not extend in or substantially in the plane of the arm 45 as with the illustrated cable 83 and rod 87 and may, for example, be in the form of a member extending perpendicular to the arm and upon which a user can supply a force to cause the arm to move from the closed to the open position.

While this invention has been illustrated and described in accordance with a preferred embodiment, it is recognized that variations and changes may be made therein without departing from the invention as set forth in the claims.

What is claimed is:

1. A latch assembly for securing a first member to a second member, the second member having a connecting bar, the latch assembly comprising:

a plate having a top surface adapted to be attached to a bottom surface of the first member and a side surface substantially perpendicular to the top surface;

an activating member; and an arm attached to the side surface of the plate and pivotable by the activating member between a closed and an open position relative to the plate about a pivot axis, wherein the pivot axis is substantially aligned with a line of entry of the connecting bar to a latched position in which, when the arm is in the closed position, a portion of the connecting bar transverse to the line of entry is disposed in an enclosed opening having an axis transverse to the line of entry, the opening being defined by both the plate and the arm together, the portion of the connecting bar being partially surrounded by the arm and the plate individually, the plate being fixed relative to the line of entry, wherein a longitudinal axis of the arm extends parallel to the line of entry when the arm is in the closed position, and wherein the axis of the enclosed opening and the line of entry of the connecting bar are substantially parallel to the top surface of the plate.

2. The latch assembly as set forth in claim 1, further comprising a stop arranged to stop the arm in the closed position.

3. The latch assembly as set forth in claim 2, wherein the stop is substantially aligned with the line of entry.

4. The latch assembly as set forth in claim 1, wherein a forward surface of the plate and a forward surface of the arm define a V-shape when the arm is in the closed position.

5. The latch assembly as set forth in claim 4, wherein a centerline of the V-shape is substantially parallel to the line of entry.

6. The latch assembly as set forth in claim 1, wherein the latch assembly is arranged such that the arm tends to move to the closed position.

7. The latch assembly as set forth in claim 1, further comprising a spring arranged to move the arm to the closed position.

8. The latch assembly as set forth in claim 1, further comprising a magnet arranged to move the arm to the closed position.

9. The latch assembly as set forth in claim 1, further comprising non-gravity means for moving the arm to the closed position.

10. The latch assembly as set forth in claim 1, wherein the arm comprises a notch, the connecting bar being held in the notch when the connecting bar is in the latched position and the arm is in the closed position.

11. The latch assembly as set forth in claim 10, wherein the notch is substantially aligned with the line of entry.

12. The latch assembly as set forth in claim 1, further comprising a coil spring arranged around the pivot axis to move the arm to the closed position.

13. The latch assembly as set forth in claim 1, wherein the first article is a table and the top surface is a table top.

14. A latch assembly for securing a first member to a second member, the second member having a connecting bar, the latch assembly comprising:

a plate having a top surface adapted to be attached to a bottom surface of the first member and a side surface substantially perpendicular to the top surface;

an activating member; and an arm attached to the side surface of the plate and pivotable by the activating member between a closed and an open position relative to the plate about a pivot axis, wherein the pivot axis is substantially aligned with a line of entry of the connecting bar to a latched position in which, when the arm is in the closed position, a portion of the connecting bar transverse to the line of entry is disposed in an enclosed opening having an axis transverse to the line of entry, the opening being defined by both the plate and the arm together, the portion of the connecting bar being partially surrounded by the arm and the plate individually, the plate being fixed relative to the line of entry, wherein the arm forms part of a lever, the lever comprising a second arm extending at a non-zero angle relative to the arm from proximate the pivot axis, and wherein the axis of the enclosed opening and the line of entry of the connecting bar are substantially parallel to the top surface of the plate.

15. The latch assembly as set forth in claim 14, wherein the activating member is attached to the second arm and arranged such that application of a force upon the activating member tends to move the arm to the open position.

16. The latch assembly as set forth in claim 15, wherein the activating member is attached to the plate.

17. The latch assembly as set forth in claim 15, wherein the activating member comprises a cable.

18. The latch assembly as set forth in claim 15, wherein the activating member comprises a rod.

19. The latch assembly as set forth in claim 15, wherein a longitudinal axis of the arm extends substantially parallel to the line of entry when the arm is in the closed position.

20. The latch assembly as set forth in claim 19, wherein a longitudinal axis of the second arm extends non-parallel to the line of entry.

21. The latch assembly as set forth in claim 15, wherein a longitudinal axis of the second arm extends non-parallel to the line of entry.

22. An arrangement comprising a latch assembly, comprising:

a first assembly comprising a first surface and, extending relative to the surface, a connecting bar, the connecting bar having a first portion that extends generally perpendicular to at least part of the first surface and a second portion that extends generally perpendicular to the first portion; and a second assembly comprising an article having a second, substantially flat surface and a plate having a top surface adapted to be attached to a bottom surface of the article and a side surface, the plate being attached to the article so that the second surface of the article is substantially perpendicular to the side surface of the plate, an activating member, and an arm attached to the side surface of the plate and pivotable under a force by the activating member between a closed and an open position relative to the plate about a pivot axis, wherein the pivot axis is substantially aligned with a line of entry of the second portion of the connecting bar to a latched position in which, when the arm is in the closed position, a portion of the second portion of the connecting bar transverse to the line of entry is disposed in an enclosed opening having an axis transverse to the line of entry, the opening being defined by both the plate and the arm together, the portion of the second portion of the connecting bar being partially surrounded by the arm and the plate individually, the plate being fixed relative to the line of entry, wherein a longitudinal axis of the arm extends parallel to the line of entry when the arm is in the closed position, and wherein the axis of the enclosed opening and the line of entry of the second portion of the connecting bar are substantially parallel to the top surface of the plate.

23. A latch assembly for securing a first member to a second member, the second member having a connecting bar, the latch assembly comprising:

a plate having a top surface adapted to be attached to a bottom surface of the first member and a side surface substantially perpendicular to the top surface;

an activating member; and an arm attached to the side surface of the plate and pivotable by the activating member between a closed and an open position relative to the plate about a pivot axis, and wherein the pivot axis is substantially aligned with a line of entry of the connecting bar to a latched position in which, when the arm is in the closed position, a portion of the connecting bar transverse to the line of entry is disposed in an enclosed opening having an axis transverse to the line of entry, the opening being defined by both the plate and the arm together, the portion of the connecting bar being partially surrounded by the arm and the plate individually, the plate being fixed relative to the line of entry, wherein a longitudinal axis of the arm extends parallel to the line of entry when the arm is in the closed position, and wherein the axis of the enclosed opening and the line of entry of the connecting bar are substantially parallel to the top surface of the plate; and a stop arranged to stop the arm in the closed position, wherein the stop is substantially aligned with the line of entry.

* * * * *